US008602756B2

(12) United States Patent
Takeuchi et al.

(10) Patent No.: US 8,602,756 B2
(45) Date of Patent: Dec. 10, 2013

(54) SCROLL TYPE COMPRESSOR HAVING AN ELASTIC MEMBER TO SUPPRESS NOISE AND REDUCE VARIATIONS

(75) Inventors: Makoto Takeuchi, Aichi (JP); Takayuki Suzuki, Aichi (JP); Masahiro Ohta, Aichi (JP); Kazuhide Watanabe, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 181 days.

(21) Appl. No.: 13/142,194

(22) PCT Filed: Dec. 22, 2009

(86) PCT No.: PCT/JP2009/007109

§ 371 (c)(1),
(2), (4) Date: Jul. 29, 2011

(87) PCT Pub. No.: WO2010/073612

PCT Pub. Date: Jul. 1, 2010

(65) Prior Publication Data

US 2011/0280758 A1 Nov. 17, 2011

(30) Foreign Application Priority Data

Dec. 24, 2008 (JP) ..... 2008-327919

(51) Int. Cl.

| | |
|---|---|
| ***F03C 4/00*** | (2006.01) |
| ***F04C 2/00*** | (2006.01) |
| ***F04C 18/00*** | (2006.01) |

(52) U.S. Cl.

USPC ..... 418/55.5; 418/55.1; 418/57; 418/151; 418/182

(58) Field of Classification Search

USPC ..... 418/55.1–55.6, 57, 151, 181–182, 270, 418/DIG. 1

See application file for complete search history.

(56) References Cited

U.S. PATENT DOCUMENTS 5,681,155 A 10/1997 Hisanaga et al.

FOREIGN PATENT DOCUMENTS

| | | | |
|---|---|---|---|
| JP | 01-271681 | A | 10/1989 |
| JP | 2006-57520 | A | 3/2006 |
| JP | 3781460 | B2 | 5/2006 |
| JP | 2008-202562 | A | 9/2008 |
| JP | 2008-208717 | A | 9/2008 |

OTHER PUBLICATIONS

JP 2008-208717 A, Ishikawa et al., Scroll Compressor, Sep. 11, 2008—Machine English Translation.*

(Continued)

*Primary Examiner* — Theresa Trieu

(74) *Attorney, Agent, or Firm* — Westerman, Hattori, Daniels & Adrian, LLP

(57) ABSTRACT

Provided is a scroll type compressor which reduces variations in the pressing load of a rotating scroll on a fixed scroll, reduces the impact at the start of the compressor and suppresses noises, and can provide excellent durability. A peripheral elastic body 51 and a bottom-portion elastic body 52, which is brought into a compressed condition in the axis line direction of the main shaft 31, are interposed between a stopper pin 41 on the rotating scroll side and a concave portion 42 on the main shaft 31 side, whereby working errors of each part are compensated and the rotating scroll is constantly brought into close contact with the fixed scroll to maintain the sealing of the compression chamber.

7 Claims, 7 Drawing Sheets

(56) References Cited

OTHER PUBLICATIONS

Notification of Transmittal of Translation of the International Preliminary Report on Patentability (Form PCT/IB/338) of International Application No. PCT/JP2009/007109 mailed Aug. 18, 2011 with Forms PCT/IB/373 and PCT/ISA/237.

International Search Report of PCT/JP2009/007109, mailing date Mar. 16, 2010.

* cited by examiner

PRIOR ART

PRIOR ART

SCROLL TYPE COMPRESSOR HAVING AN ELASTIC MEMBER TO SUPPRESS NOISE AND REDUCE VARIATIONS

TECHNICAL FIELD

The present invention relates to a scroll type compressor which constitutes an in-car air conditioner and the like.

BACKGROUND ART

A scroll type compressor is provided with a fixed scroll and a rotating scroll, each having a volute-like scroll wall. And the rotating scroll is caused to perform revolving turning motions with respect to the fixed scroll and the volume of a compression chamber formed between the two scroll walls is reduced, whereby the compression of a fluid in the compression chamber is performed.

As shown in FIG. 6, in such a compressor 1, a cooling medium sucked from a suction port into a housing 2 is conducted into a compression chamber formed between a rotating scroll 3B and a fixed scroll 3A. The cooling medium in the compression chamber is compressed by the revolution of the rotating scroll 3B with respect to the fixed scroll 3A and is discharged from a discharge port formed in the housing 2 to the outside.

Here, the rotating scroll 3B is supported by a boss 4*a* provided so as to be offset from the rotation center of a main shaft 4 by a prescribed size. As a result of this, the rotating scroll 3B is supported rotatably (i.e., in a revolvable way) via a bearing 5 with respect to the main shaft 4 which is rotatably driven from the outside. In order to prevent the rotating scroll 3B from rotating on its own axis while revolving, an Oldham's ring which is not shown in the figure is interposed between the rotating scroll 3B and the main shaft 4.

Besides, the main shaft 4 is provided with a balancer 6 in order to eliminate the imbalance due to the rotating scroll 3B which has become eccentric with respect to the main shaft 4. The balancer 6 is such that a weight portion 6*b* is integrally formed in an outer circumferential portion of a fan-like plate portion 6*a* which extends in a direction opposite to the direction in which the rotating scroll 3B has become eccentric.

Although the fixed scroll 3A and the rotating scroll 3B are formed each with accuracies within prescribed tolerances, delicate dimensional errors within the tolerances nevertheless exist. Also, the accuracy and the like of the main shaft 4 have an effect on the positional accuracy of the rotating scroll 3B with respect to the fixed scroll 3A.

The rotating scroll 3B is constructed so as to be movable with respect to the main shaft 4 within a given range so that there is no harm in the relative rotation between the fixed scroll 3A and the rotating scroll 3B even if these dimensional errors exist (refer to Patent Document 1, for example). Specifically, the construction is such that the rotating scroll 3B and the balancer 6 are allowed to rotate at a given angle with respect to the boss 4*a* of the main shaft 4 around the center axis of the boss 4*a*. A stopper pin 7 is provided in the plate portion 6*a* of the balancer 6. In the main shaft 4, a concave portion 8 which houses the stopper pin 7 is formed in a position opposed to the stopper pin 7. The inside diameter of the concave portion 8 is formed larger than the outside diameter of the stopper pin 7 by a given size, whereby a clearance is formed between the stopper pin 7 and the concave portion 8. Therefore, the stopper pin 7 provided in the balancer 6 is adapted to be movable in the interior of the concave portion 8 around the center of the boss 4*a* within the range of the above-described clearance. As a result of this, when the rotating scroll 3B and the balancer 6 rotates around the boss 4*a* of the main shaft 4, the rotating scroll 3B and the balancer 6 are allowed to revolve in the range of the clearance between the stopper pin 7 and the concave portion 8. In this manner, the rotating scroll 3B is caused to be movable within a given permissible range, whereby manufacturing errors and the like of each part are compensated and the rotating scroll 3B is constantly brought into close contact with the fixed scroll 3A.

As described above, in a construction in which the rotating scroll 3B is movable with respect to the fixed scroll 3A, during the operation of the compressor 1, the rotating scroll 3B is pressed against the fixed scroll 3A by the pressure of the compression chamber formed between the fixed scroll 3A and the rotating scroll 3B and by the centrifugal force generated in the balancer 6. However, during the stop of the compressor 1, the rotating scroll 3B is away from the fixed scroll 3A. When the compressor 1 is started from this condition, the rotating scroll 3B collides against the fixed scroll 3A and impact noises of this collision may sometimes be generated.

Therefore, there has been proposed a scroll type compressor having a construction in which the rotating scroll 3B is movable with respect to the main shaft 4 as described above, in which an elastic body is provided between the main shaft 4 and the rotating scroll 3B, whereby an impact generated by the collision between the fixed scroll 3A and the rotating scroll 3B is absorbed (refer to Patent Document 2, for example).

CITATION LIST

Patent Document 1: Japanese Patent Laid-Open No. 1-271681

Patent Document 2: Japanese Patent No. 3781460

SUMMARY OF INVENTION

Problem to be Solved

In the case where an elastic body is provided between the main shaft 4 and the rotating scroll 3B, when the rotating scroll 3B moves with respect to the main shaft 4 in the range of the clearance between the stopper pin 7 and the concave portion 8, the rotating scroll 3B receives a reaction force from the elastic body according to the amount of movement. This reaction force becomes the load (hereinafter appropriately referred to as the pressing load) under which the rotating scroll 3B is pressed against the fixed scroll 3A.

Here, as shown in FIG. 7, even when the working accuracies of each part, such as the main shaft 4 and the rotating scroll 3B, are within the specified tolerances, in the initial condition (the no-load condition), variations occur in the reaction force from the elastic body, i.e., the pressing load of the rotating scroll 3B on the fixed scroll 3A. For example, in the case where the stopper pin 7 is relatively large compared to the concave portion 8, a large reaction force is generated in an elastic body already in a more initial condition and the pressing load comes to a large condition in comparison to the case where the stopper pin 7 is relatively small compared to the concave portion 8. Contrary to this, in the case where the stopper pin 7 is relatively small compared to the concave portion 8, in an elastic body, the reaction force is small already in a more initial condition and also the pressing load is small. Therefore, when the compressor 1 begins to operate, the load under which the rotating scroll 3B is pressed against the fixed scroll 3A varies greatly.

Needless to say, it is preferred that such variations in the pressing load of the rotating scroll 3B on the fixed scroll 3A be reduced as much as possible. If the pressing load becomes excessive, heat generation, friction and the like occur in the contact portions of the fixed scroll 3A and the rotating scroll 3B. For this reason, there is a technique for increasing the working accuracy of each part as one method. However, this technique is not desirable because this leads directly to a rise in working cost.

Also, as described above, it is preferred to reduce the impact due to the collision between the fixed scroll 3A and the rotating scroll 3B at the start of the compressor 1 from the standpoints of noise and durability. However, in the technique disclosed in Patent Document 2, when the compressor 1 is in an initial no-load condition, the fixed scroll 3A and the rotating scroll 3B are throughout in a noncontact condition. It is intended to reduce the impact occurring during the collision between the fixed scroll 3A and the rotating scroll 3B, which has been in a non-contact condition, when this compressor 1 begins to start. Therefore, with the technique disclosed in Patent Document 2, the impact still exists, although the impact is absorbed.

The present invention was devised on the basis of such technical problems, and the object of the invention is to provide a scroll type compressor which reduces variations in the pressing load of a rotating scroll on a fixed scroll, reduces the impact at the start of the compressor and suppresses noises, and can provide excellent durability.

Means for Solving the Problems

To achieve the above object, the present invention provides a scroll type compressor comprising: a main shaft that is rotatably supported in a housing that constitutes an outer shell; a rotating scroll that is rotatably connected to a position offset with respect to the center of the main shaft, a fixed scroll that forms a compression chamber compressing a cooling medium by being opposed to the rotating scroll and is fixed to the housing; and a balancer that is provided integrally with the rotating scroll and reduces the imbalance of the rotating scroll. The scroll type compressor of the present invention further comprises a convex portion that is provided in one of the main shaft or the balancer and protrudes in a direction parallel to an axis line of the main shaft, a concave portion that is provided in the other of the main shaft or the balancer and has an inside diameter larger than the outside diameter of the convex portion, and a first elastic body that is provided in a compressed condition in the direction of the axis line between the main shaft and the balancer and exerts a resistance force on the movement of the convex portion in a direction orthogonal to the axis line in the concave portion.

The load under which the rotating scroll is pressed against the fixed scroll can be exerted by the frictional force exerted by the first elastic body.

At this time, the first elastic body is provided in a compressed condition in the axial direction between the front end portion of the convex portion and the bottom-portion of the concave portion and, therefore, even when the convex portion is displaced in a direction orthogonal to the axis line of the main shaft in the concave portion, the frictional force which is exerted is substantially constant and is less apt to be affected by the amount of displacement and dimensional errors of each part.

Here, the displacement of the convex portion, the balancer and the rotating scroll refers to a displacement occurring when the rotating scroll rotates around the boss during the rotation of the rotating scroll in order to maintain the condition in which the rotating scroll comes into constant contact with the fixed scroll.

Besides, the scroll type compressor of the present invention can be further provided with a second elastic body provided between an outer circumferential surface of the convex portion and an inner circumferential surface of the concave portion. As a result of this, for the load under which the rotating scroll is pressed against the fixed scroll, the first elastic body can bear an initial pressing load and the second elastic body can bear a pressing load occurring when the convex portion is displaced in the direction orthogonal to the axis line of the main shaft in the concave portion.

Here, it is preferred that when the convex portion moves in the direction orthogonal to the axis line in the concave portion, the frictional force exerted by the first elastic body is larger than the repulsive force exerted by the second elastic body.

The second elastic body may be provided only on the outer circumferential side of the rotational radius of the rotating scroll instead of being provided along the whole circumference between the outer circumferential surface of the convex portion and the inner circumferential surface of the concave portion. As a result of this, the assemblability is improved.

The first elastic body and the second elastic body may be integrally formed or may be separate parts.

Moreover, the first elastic body and the second elastic body may be formed from materials different from each other and may have thicknesses different from each other.

Advantageous Effects of Invention

According to the present invention, the loads under which the rotating scroll is pressed against the fixed scroll are exerted by the first elastic body and the second elastic body and the sealing performance of the compression chamber is secured. At this time, by ensuring that the frictional force exerted by the first elastic body when the convex portion has moved in the direction orthogonal to the axis line in the concave portion, is larger than the repulsive force exerted by the second elastic body, it is possible to reduce an increase or a decrease in the pressing load exerted by the second elastic body when the rotating scroll has been displaced. As a result, even when in the clearance between the concave portion and the convex portion there are errors in the working tolerances of the rotating scroll, the fixed scroll, the main shaft and the like, it is possible to reduce variations in the pressing load exerted by the second elastic body.

Besides, in a no-load condition (the condition in which the compressor is not operating), it is possible to hold the convex portion in a given position in the concave portion by use of the first elastic body and the second elastic body and it is possible to ensure the arrangement in which the rotating scroll is pressed against the fixed scroll in constant contact relation. As a result of this, it is possible to prevent the rotating scroll, which has been in a noncontact condition, from colliding against the fixed scroll, thereby generating noises at the start of the compressor. Thus, it is possible to make a low-noise compressor.

DESCRIPTION OF EMBODIMENTS

Hereinafter, the present invention will be described in detail on the basis of the embodiment shown in the accompanying drawings.

Figure 1:
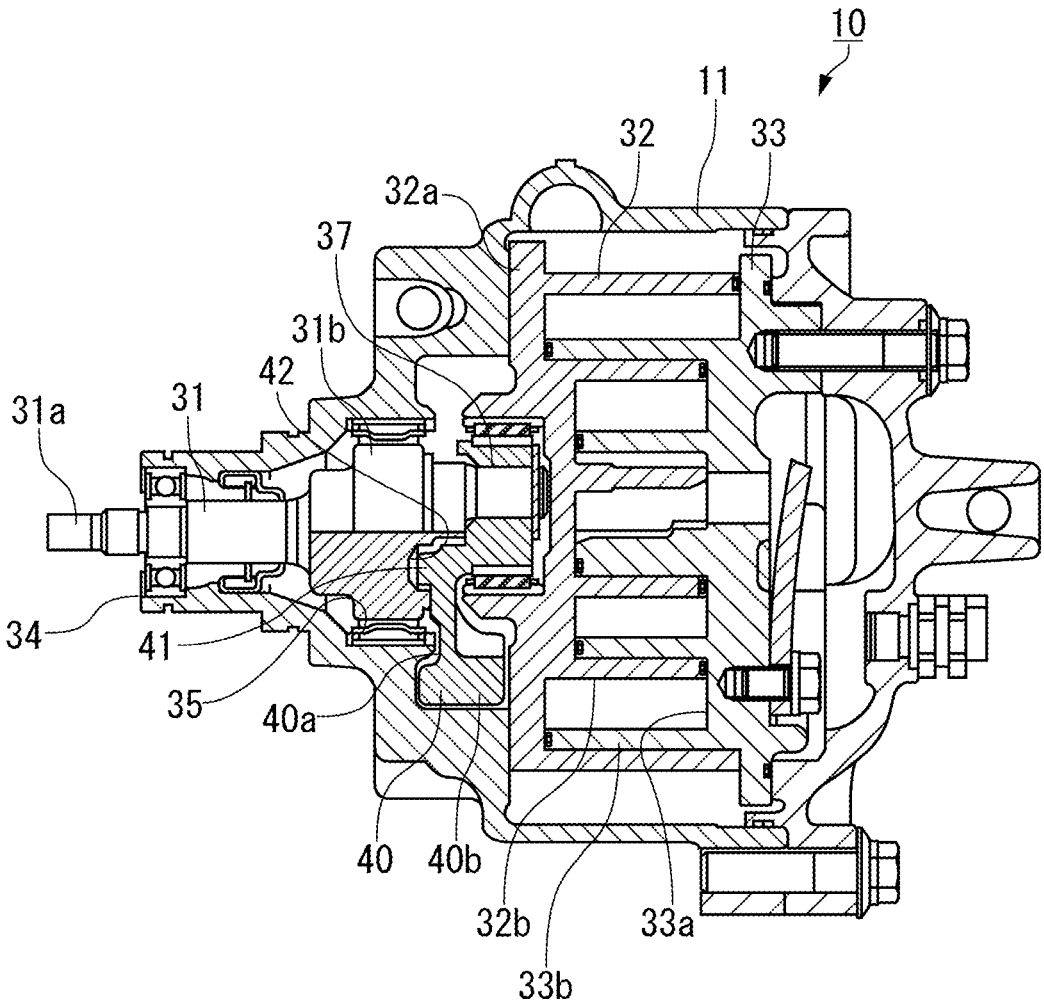
FIG. 1 is a sectional view of a compressor in this embodiment.

FIG. 1 is a drawing to show the arrangement of a compressor 10 in this embodiment.

As shown in FIG. 1, the compressor 10 is of a scroll type and is provided with, within a housing 11, a main shaft 31 and a rotating scroll 32 which rotates along with the main shaft 31, and a fixed scroll 33 fixed to the housing 11.

In such a compressor 10 like this, a cooling medium is introduced from a cooling medium introduction port formed on one end side of the housing 11 into the housing 11, and the cooling medium is compressed in a compression chamber formed between the rotating scroll 32 and the fixed scroll 33. And the compressed cooling medium is discharged from a cooling medium discharge port formed on the other end side of the housing 11.

The main shaft 31 is such that both end portions thereof are rotatably supported via bearings 34, 35. One end 31*a* of the main shaft 31 pierces through the housing 11 and protrudes to the outside, and a driving source not shown in the figure is connected to one end 31*a*. Here, in the case where an engine is the driving source, a belt or the like which is not shown in the figure is wound on one end 31*a* of the main shaft 31, and the main shaft 31 is connected to the engine to transmit a driving force. Also, as the driving source, a motor or the like can be used in addition to an engine of a vehicle. When a motor is used as the driving source, the rotary shaft of the motor and the main shaft 31 may be connected by a belt, a gear and the like and the rotary shaft of the motor may be used as the main shaft 31. In this case, it is also possible to house the motor integrally in the interior of the housing 11.

Each of the rotating scroll 32 and the fixed scroll 33 is such that a volute-like scroll wall 32*b*, 33*b* is installed in a standing manner on one surface side of a disk-like end plate 32*a*, 33*a*. The rotating scroll 32 and the fixed scroll 33 form a compression chamber between the two scroll walls 32*b*, 33*b* by combining the scroll walls 32*b*, 33*b* together.

In the other end portion 31*b* of the main shaft 31, there is formed a boss 37 in a protruding manner in a position eccentric away from the central axis of the main shaft 31 by a predetermined size. The rotating scroll 32 is rotatably held by this boss 37. As a result of this, the rotating scroll 32 is provided so as to be eccentric with respect to the center of the main shaft 31 by a predetermined size. And when the main shaft 31 rotates along the axis line thereof, the rotating scroll 32 performs a rotation (a revolution) with a radius of the eccentric size with respect to the center of the main shaft 31. In order to prevent the rotating scroll 32 from rotating on its own axis while revolving, an Oldham's ring which is not shown in the figure is interposed between the rotating scroll 32 and the main shaft 31.

Furthermore, between the rotating scroll 32 and the main shaft 31, a balancer 40 is provided in order to eliminate the imbalance due to the rotating scroll 32 which has become eccentric with respect to the main shaft 31. The balancer 40 is such that a weight portion 40*b* is integrally formed in an outer circumferential portion of a fan-like plate portion 40*a* which extends in a direction opposite to the direction in which the rotating scroll 32 has become eccentric.

Figure 2:
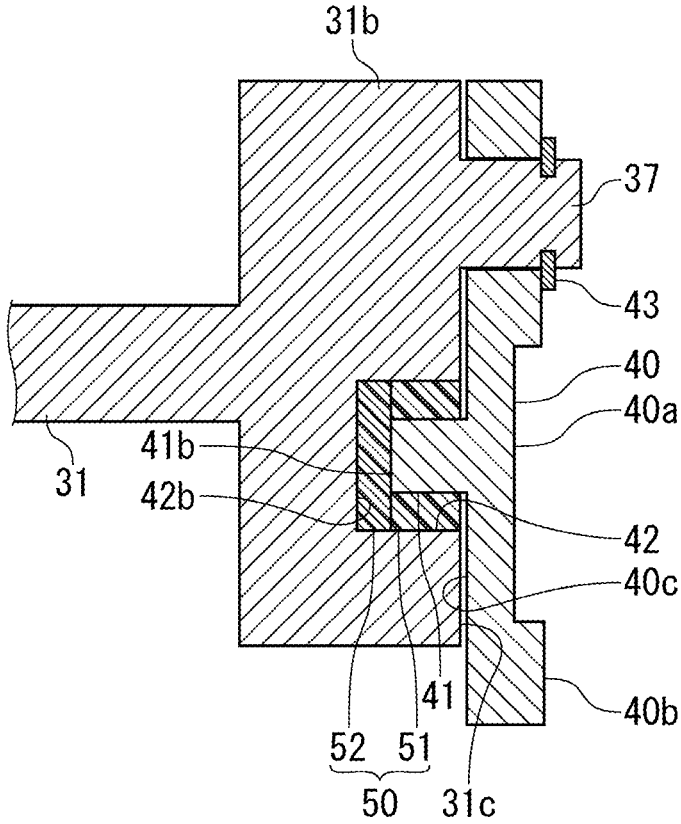
FIG. 2 is a sectional view showing an elastic member provided between a main shaft and a balancer.
Figure 3:
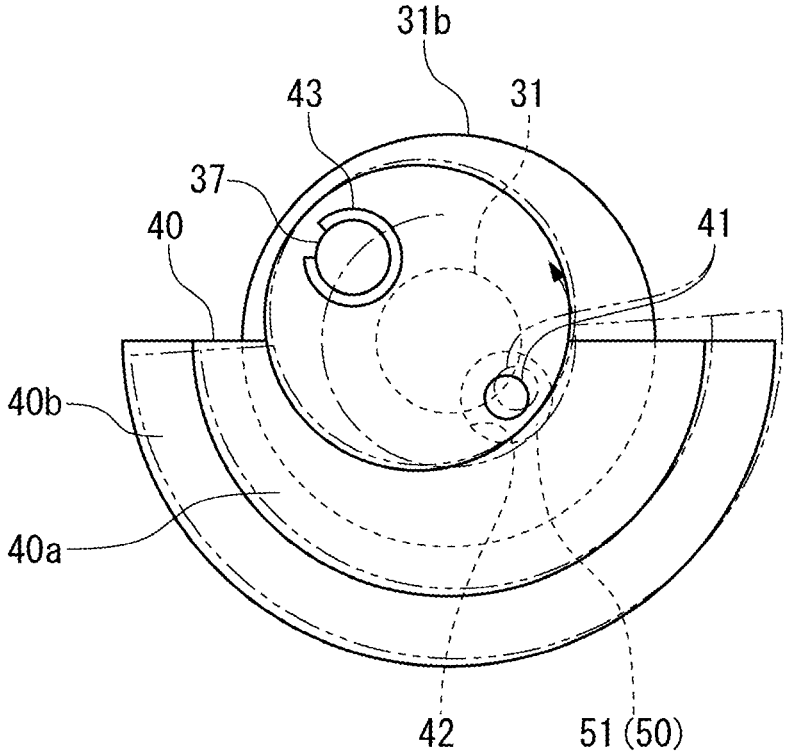
FIG. 3 is a side view of FIG. 2.

As shown in FIGS. 2 and 3, in the plate portion 40*a* of the balancer 40, there is provided a stopper pin (a convex portion) 41 which protrudes to the side opposite to the surface opposed to the rotating scroll 32. In the main shaft 31, in a position opposed to the stopper pin 41, there is formed a concave portion 42 which houses the stopper pin 41. This concave portion 42 is such that the inside diameter thereof is formed to be by a given size larger than the outside diameter of the stopper pin 41, whereby a clearance is formed between the stopper pin 41 and the concave portion 42. As a result of this, the stopper pin 41 provided in the balancer 40 is adapted to be movable in the interior of the concave portion 42 within the range of the above-described clearance.

Figure 4:
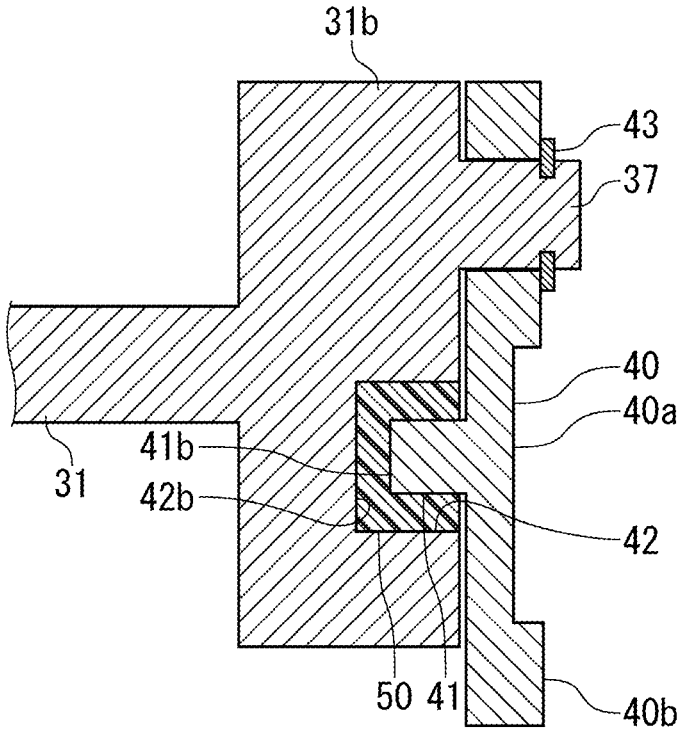
FIG. 4 is a sectional view showing another example of an elastic member provided between a main shaft and a balancer.

Here, as shown in FIG. 2, an elastic member 50 is provided in the clearance between the concave portion 42 and the stopper pin 41. The elastic member 50 is formed from a cylindrical peripheral elastic body (a second elastic body) 51 interposed between the inner circumferential surface of the concave portion 42 and the outer circumferential surface of the stopper pin 41 and a disk-like bottom-portion elastic body (a first elastic body) 52 interposed between a bottom-portion 42*b* of the concave portion 42 and a front end surface 41*b* of the stopper pin 41. The peripheral elastic body 51 and the bottom-portion elastic body 52 may be formed as separate parts, or as shown in FIG. 4, the elastic member 50 may have a shape obtained by integrating the peripheral elastic body 51 and the bottom-portion elastic body 52.

The bottom-portion elastic body 52 is provided so as to be interposed in a compressed condition between the bottom-portion 42*b* of the concave portion 42 and the front end surface 41*b* of the stopper pin 41. For this reason, a stopper ring 43 provided in the main shaft 31 restrains the balancer 40 from moving to the rotating scroll 32 side. As a result of this, the clearance between the bottom-portion 42*b* of the concave portion 42 and the front end surface 41*b* of the stopper pin 41 is set smaller than the natural length of the bottom-portion elastic body 52 in the thickness direction.

The peripheral elastic body 51 and the bottom-portion elastic body 52 are assembled in a condition capable of exerting a predetermined pressing force so as to maintain the condition in which the rotating scroll 32 is pressed against the fixed scroll 33 even when the compressor 10 is in a no-load condition. For this purpose, designing is performed so that when the compressor 10 is in a no-load condition, the stopper pin 41 is offset from the center of the concave portion 42, and the stopper pin 41 causes the peripheral elastic body 51 and the bottom-portion elastic body 52 to come to a deformed condition.

The peripheral elastic body 51 and the bottom-portion elastic body 52 are each formed from a rubber-based material or others having elasticity.

The peripheral elastic body 51 interposed between the inner circumferential surface of the concave portion 42 and the outer circumferential surface of the stopper pin 41 becomes elastically deformed when the stopper pin 41 has been displaced in the direction orthogonal to the axis line of the stopper pin 41 in the concave portion 42, and causes a reaction force to act on the stopper pin 41. That is, when the rotating scroll 32 has been displaced in the radial direction of the main shaft 31 due to contact with the fixed scroll 33, the peripheral elastic body 51 causes a reaction force to act.

On the other hand, the bottom-portion elastic body 52 constantly causes a frictional force to act constantly on the stopper pin 41 by being interposed in a compressed condition between the bottom-portion 42*b* of the concave portion 42 and the front end surface 41*b* of the stopper pin 41. And when stopper pin 41 has been displaced in the direction orthogonal to the axis line of the stopper pin 41 in the concave portion 42, the bottom-portion elastic body 52 causes a frictional resistance force to act on the stopper pin 41. That is, when the rotating scroll 32 has been displaced in the radial direction of the main shaft 31 due to contact with the fixed scroll 33, the bottom-portion elastic body 52 causes a frictional resistance force to act.

Figure 5:
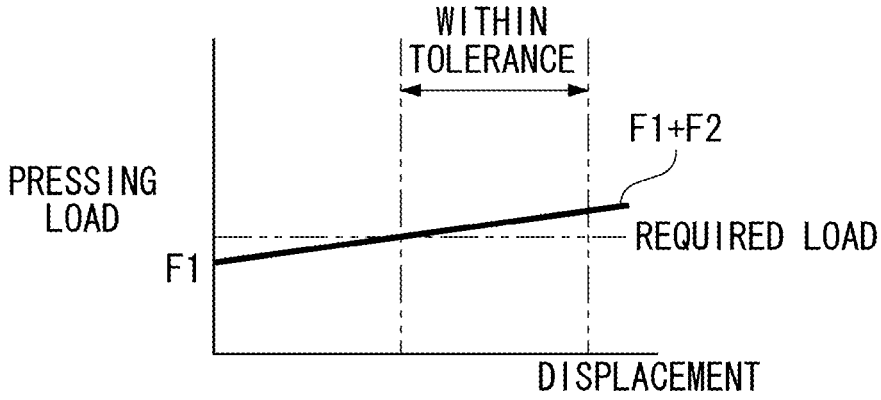
FIG. 5 is a diagram showing the relationship between the displacement of a convex portion and a contact load of a rotating scroll on a fixed scroll in this embodiment.
Figure 6:
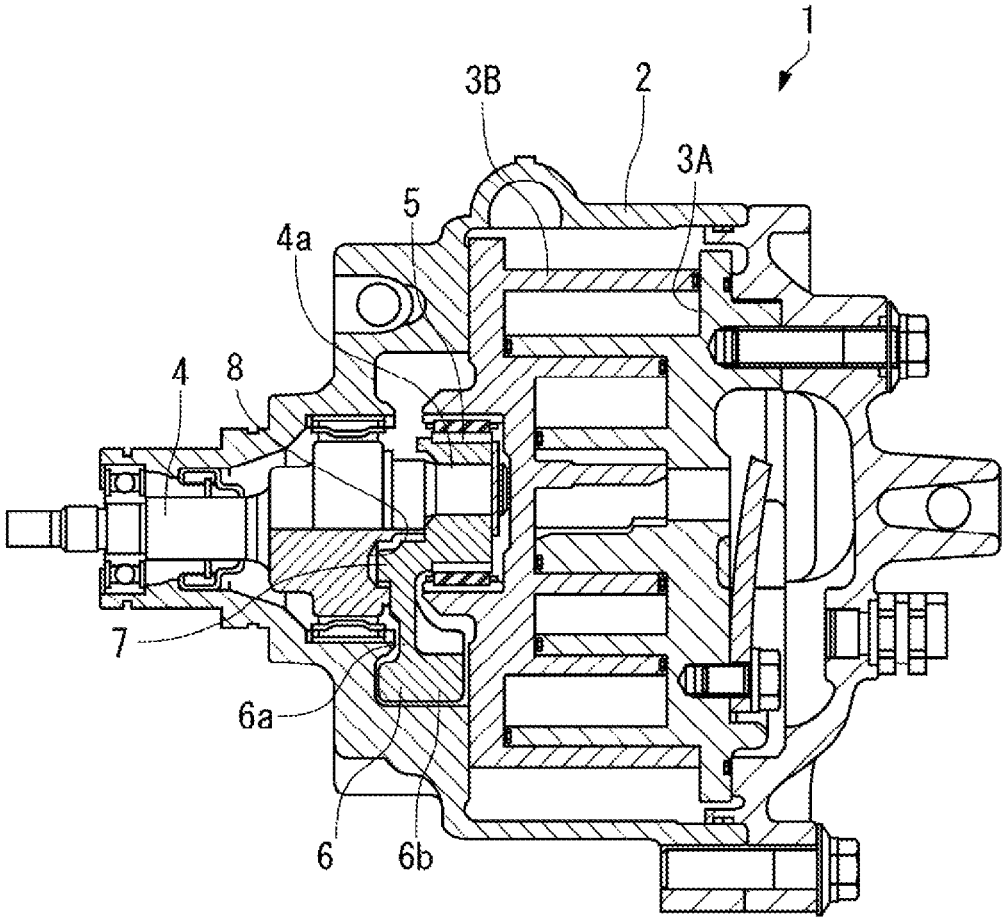
FIG. 6 is a sectional view of a conventional compressor.
Figure 7:
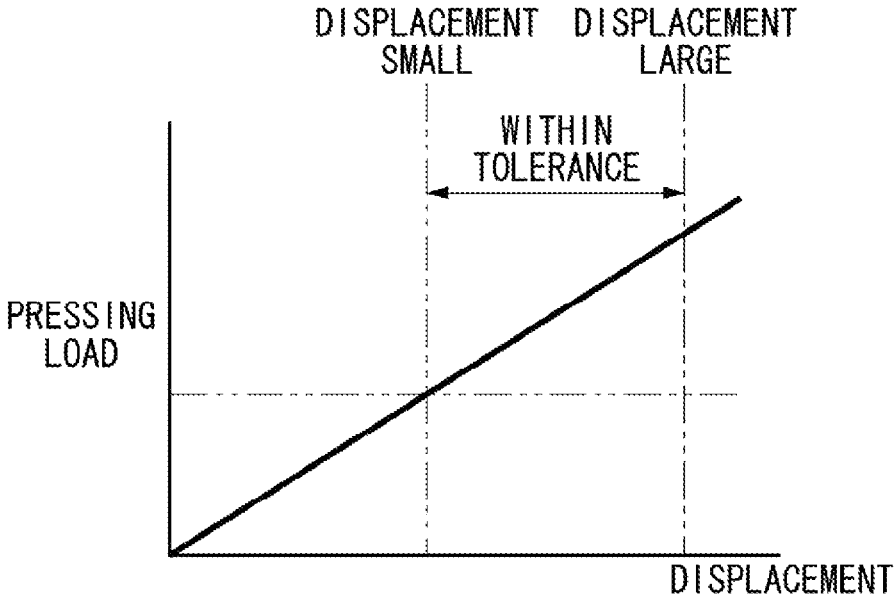
FIG. 7 is a diagram showing the relationship between the displacement of a convex portion and a contact load of a rotating scroll on a fixed scroll in a conventional compressor.

Because of such an arrangement, when the rotating scroll 32 is to be displaced in the radial direction of the main shaft 31 due to contact with the fixed scroll 33, a reaction force by the peripheral elastic body 51 and a frictional resistance force by the bottom-portion elastic body 52 act. As a result of this, the peripheral elastic body 51 and the bottom-portion elastic body 52 give pressing loads on the scroll wall 32*b* of the rotating scroll 32 and the scroll wall 33*b* of the fixed scroll 33. Therefore, the relationship between the displacement of the rotating scroll 32 in the radial direction of the main shaft 31 and the pressing load becomes as shown in FIG. 5. That is, an initial pressing load F1 is given to the rotating scroll 32 by the frictional resistance force of the bottom-portion elastic body 52, and when the rotating scroll 32 is displaced, a displacement pressing load F2 due to the reaction force by the peripheral elastic body 51 is added. The larger the displacement of the rotating scroll 32 becomes, the more this displacement pressing force F2 by the peripheral elastic body 51 increases.

When the ratio of the initial pressing load F1 by the bottom-portion elastic body 52 is increased, taking the working tolerances of each part into consideration, it is possible to reduce an increase or a decrease in the displacement pressing load F2 within the range in which the stopper pin 41 is displaced in the concave portion 42 (within the range indicated as "TOLERANCE" in FIG. 5.). That is, in FIG. 5, it is possible to reduce the gradient of a change in the pressing load occurring when the rotating scroll 32 has been displaced. Then, even when there are errors in the clearance between the stopper pin 41 and the concave portion 42 within the range of the working tolerances of the rotating scroll 32, the fixed scroll 33, the main shaft 31 and the like, it is possible to reduce variations in the pressing load which is caused to act on the rotating scroll 32 by the elastic member 50 within that range.

Therefore, it is preferred that the ratio of the initial pressing load F1 by the bottom-portion elastic body 52 to a maximum value (initial pressing load F1+displacement pressing load F2) of the pressing load acting on the rotating scroll 32 when the rotating scroll 32 has been displaced to a maximum degree (this displacement is a maximum displacement of the stopper pin 41 in the concave portion 42 in which the working allowances are taken into consideration) be high, and for example, this ratio is preferably not less than 50%, more preferably on the order of 70%.

This ratio can be 100%, that is, only the bottom-portion elastic body 52 is provided without the provision of the peripheral elastic body 51. However, because the displacement of the stopper pin 41 in the concave portion 42 occurs at high speeds during the rotation of the rotating scroll 32 and the fixed scroll 33, it is preferred that the variation component of the displacement be borne by the peripheral elastic body 51.

This can be accomplished by giving different values of modulus of elasticity to the peripheral elastic body 51 and the bottom-portion elastic body 52 (using different qualities of material), or by using different thicknesses. These may be set according to the required performance and appropriately designed.

In this manner, the elastic member 50 formed from the peripheral elastic body 51 and the bottom-portion elastic body 52 is interposed between the rotating scroll 32, which is movable, and the main shaft 31, whereby the working errors of each part are compensated and the rotating scroll 32 is constantly brought into contact with the fixed scroll 33 at contact pressures of not less than a given level, making it possible to maintain the sealing of the compression chamber. In particular, by reducing the gradient of a change in the pressing load occurring when the rotating scroll 32 has been displaced, even in the case where each part has working errors, within the range of the working errors, variations in the pressing load which is caused to act on the rotating scroll 32 by the elastic member 50 are reduced, whereby it is possible to reliably bring the rotating scroll 32 and the fixed scroll 33 into contact with each other, with stable contact pressures maintained. Moreover, such effects can be realized at low cost without a special increase of the working accuracies of each part.

Furthermore, in a no-load condition (the condition in which the compressor 10 is not operating), it is possible to hold the stopper pin 41 in a given position in the concave portion 42 by use of the elastic member 50. Hence, it is possible to develop an arrangement such that in a no-load condition, the rotating scroll 32 comes into constant contact with the fixed scroll 33.

As a result of this, it is possible to prevent the rotating scroll 32, which has been in a noncontact condition, from colliding against the fixed scroll 33, thereby generating noises at the start of the compressor 10. Thus, it is possible to make a low-noise compressor 10.

Although in the above-described embodiment, the general arrangement of the compressor 10 was described, the present inventors have no intention to limit the arrangement to the above-described one, and it is needless to say that the present invention can be applied to compressors having other arrangements.

The position where the bottom-portion elastic body 52 is mounted is not limited to the above-described position so long as it is between the main shaft 31 and the balancer 40. For example, the bottom-portion elastic body 52 may be interposed between the front end surface 31*c* of the main shaft 31 and a back surface 40*c* of the plate portion 40*a* of the balancer 40.

Furthermore, although the peripheral elastic body 51 is cylindrical, the shape is not limited to this. In an arrangement in which the peripheral elastic body 51 is interposed between the inner circumferential surface of the concave portion 42 and the outer circumferential surface of the stopper pin 41, the peripheral elastic body 51 may be provided only on the outer circumferential side of the rotational radius of the rotating scroll 32 instead of being provided along the whole circumference between the inner circumferential surface of the concave portion 42 and the outer circumferential surface of the stopper pin 41. With this arrangement, impact noises at start may be suppressed. As a result, the assemblability is improved.

In addition to the foregoing, it is possible to make a choice from the arrangements enumerated in the above-described embodiment and to make appropriate changes to other arrangements so long as this does not deviate from the spirit of the present invention.

Reference Signs List

10 . . . compressor, 11 . . . housing, 31 . . . main shaft, 31*a* . . . one end, 31*b* . . . the other end, 32 . . . rotating scroll, 32*b* . . . scroll wall, 33 . . . fixed scroll, 33*b* . . . scroll wall, 37 . . . boss, 40 . . . balancer, 40*a* . . . plate portion, 40*b* . . . weight portion, 41 . . . stopper pin (convex portion), 41*b* . . . front end surface, 42 . . . concave portion, 42*b* . . . bottom-portion, 43 . . . stopper ring, 50 . . . elastic member, 51 . . . peripheral elastic body, (second elastic body), 52 . . . bottom-portion elastic body (first elastic body)

The invention claimed is:

1. A scroll type compressor comprising:

a main shaft that is rotatably supported in a housing that constitutes an outer shell;

a rotating scroll that is rotatably connected to a position offset with respect to a center of the main shaft;

a fixed scroll that forms a compression chamber compressing a cooling medium by being opposed to the rotating scroll and is fixed to the housing;

a balancer that is provided integrally with the rotating scroll and reduces the imbalance of the rotating scroll;

a convex portion which is provided in one of the main shaft or the balancer and protrudes in a direction parallel to an axis line of the main shaft;

a concave portion which is provided in the other of the main shaft or the balancer and has an inside diameter larger than an outside diameter of the convex portion and into which the convex portion is inserted; and a first elastic body that is provided in a compressed condition in the direction of the axis line between the main shaft and the balancer and exerts a resistance force on the movement of the convex portion in a direction orthogonal to the axis line in the concave portion.

2. The scroll type compressor according to claim 1, wherein the scroll type compressor further comprises a second elastic body provided between an outer circumferential surface of the convex portion and an inner circumferential surface of the concave portion.

3. The scroll type compressor according to claim 2, wherein the second elastic body is provided on an outer circumferential side of a rotational radius of the rotating scroll between the outer circumferential surface of the convex portion and the inner circumferential surface of the concave portion.

4. The scroll type compressor according to claim 2, wherein when the convex portion moves in the direction orthogonal to the axis line in the concave portion, a frictional force exerted by the first elastic body is larger than a repulsive force exerted by the second elastic body.

5. The scroll type compressor according to claim 2, wherein the first elastic body and the second elastic body are integrally formed.

6. The scroll type compressor according to claim 2, wherein the first elastic body and the second elastic body are formed from materials different from each other.

7. The scroll type compressor according to claim 2, wherein the first elastic body and the second elastic body have thicknesses different from each other.

* * * * *

UNITED STATES PATENT AND TRADEMARK OFFICE

CERTIFICATE OF CORRECTION

PATENT NO. : 8,602,756 B2
APPLICATION NO. : 13/142194
DATED : December 10, 2013
INVENTOR(S) : Takeuchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 217 days.

Signed and Sealed this
Twenty-second Day of September, 2015

Michelle K. Lee

Michelle K. Lee
*Director of the United States Patent and Trademark Office*